US008576041B2

(12) United States Patent
Rahdar et al.

(10) Patent No.: US 8,576,041 B2
(45) Date of Patent: Nov. 5, 2013

(54) RADIAL FUSE BASE AND ASSEMBLY

(75) Inventors: Essie Rahdar, West Hills, CA (US); Seong Kook Kim, Seoul (KR)

(73) Assignee: Cooper Technologies Company, Houston, TX (US)

( * ) Notice: Subject to any disclaimer, the term of this patent is extended or adjusted under 35 U.S.C. 154(b) by 12 days.

(21) Appl. No.: 12/337,274

(22) Filed: Dec. 17, 2008

(65) Prior Publication Data

US 2010/0148914 A1 Jun. 17, 2010

(51) Int. Cl.
*H01H 85/143* (2006.01)
*H01H 85/165* (2006.01)
*H01H 85/00* (2006.01)

(52) U.S. Cl.
USPC ..... 337/227; 337/186; 337/232; 337/255; 337/187

(58) Field of Classification Search
USPC ..... 337/228, 227, 186, 232, 255, 187
See application file for complete search history.

(56) References Cited

U.S. PATENT DOCUMENTS 2,004,328 A * 6/1935 Johansson ..... 337/211
2,309,517 A * 1/1943 Linton ..... 337/242
3,110,787 A * 11/1963 Borzoni ..... 337/268
3,123,696 A * 3/1964 McAlister ..... 337/251
3,227,841 A * 1/1966 Gaia ..... 337/282
3,436,711 A * 4/1969 Borzoni ..... 337/198
3,701,068 A * 10/1972 Johnsen ..... 337/102
3,721,936 A * 3/1973 Belcher ..... 337/241
4,023,264 A * 5/1977 Schmidt et al. ..... 29/623
4,189,698 A * 2/1980 Hara ..... 337/407
4,267,543 A * 5/1981 Arikawa ..... 337/255
4,344,060 A * 8/1982 Ciesemier et al. ..... 337/260
4,349,805 A * 9/1982 Arikawa ..... 337/255
4,417,226 A * 11/1983 Asdollahi et al. ..... 337/273
4,612,529 A * 9/1986 Gurevich et al. ..... 337/255
4,628,293 A * 12/1986 Marx ..... 337/216
4,670,729 A * 6/1987 Oh ..... 337/262
4,703,299 A * 10/1987 Vermij ..... 337/158
4,751,489 A * 6/1988 Spaunhorst ..... 337/260
4,768,968 A 9/1988 Daggett et al.
4,771,260 A 9/1988 Gurevich
4,801,278 A 1/1989 Sappington
4,873,506 A 10/1989 Gurevich
4,899,123 A * 2/1990 Asdollahi et al. ..... 337/273
4,924,203 A 5/1990 Gurevich
4,928,384 A 5/1990 Gurevich
4,988,969 A * 1/1991 Gurevich ..... 337/260
5,085,600 A * 2/1992 Damron ..... 439/620.28
5,179,436 A * 1/1993 Asdollahi et al. ..... 337/203
5,287,079 A * 2/1994 Bernardi et al. ..... 337/203
5,631,619 A * 5/1997 Evans ..... 337/198
5,631,620 A * 5/1997 Totsuka et al. ..... 337/260
5,825,274 A * 10/1998 Totsuka ..... 337/190

(Continued)

OTHER PUBLICATIONS

International Search Report and Written Opinion of PCT/US2009/065886; Feb. 24, 2010; 15 pages.

(Continued)

*Primary Examiner* — Bradley Thomas
(74) *Attorney, Agent, or Firm* — Armstrong Teasdale LLP

(57) ABSTRACT

Radial fuses for protecting an electrical circuit include a nonconductive base provided with inverted flat faces sloped obliquely relative to one another that define a wider receiving area for installation of a fuse element. Restricted freedom of movement of the fuse element is accomplished, and greater fuse reliability is ensured.

8 Claims, 10 Drawing Sheets

(56) References Cited

U.S. PATENT DOCUMENTS

| | | | | |
|---|---|---|---|---|
| 6,373,370 | B1 * | 4/2002 | Darr et al. | 337/243 |
| 6,542,063 | B2 * | 4/2003 | Kawashima et al. | 337/203 |
| 6,762,670 | B1 * | 7/2004 | Yen | 337/203 |
| 6,781,503 | B1 * | 8/2004 | Kubota | 337/230 |
| 6,902,434 | B2 * | 6/2005 | Stack | 439/620.28 |
| 6,930,585 | B2 * | 8/2005 | Kawazoe | 337/186 |
| 7,094,105 | B2 * | 8/2006 | Kobayashi | 439/620.29 |
| 7,234,968 | B2 * | 6/2007 | Lottmann et al. | 439/620.01 |
| 7,473,487 | B2 * | 1/2009 | Senda et al. | 429/62 |
| 7,920,044 | B2 * | 4/2011 | Scheiber et al. | 337/186 |
| 2002/0190837 | A1 * | 12/2002 | Kalra et al. | 337/187 |
| 2004/0160301 | A1 * | 8/2004 | Kawazoe | 337/187 |
| 2006/0197647 | A1 * | 9/2006 | Whitney et al. | 337/297 |
| 2008/0272877 | A1 * | 11/2008 | Kwon | 337/198 |
| 2009/0033453 | A1 | 2/2009 | Deno et al. | |
| 2009/0108980 | A1 * | 4/2009 | Whitney et al. | 337/161 |
| 2010/0060406 | A1 * | 3/2010 | Kim et al. | 337/187 |

OTHER PUBLICATIONS

Subminiature Fuses SR-5, Time-Delay; Cooper Bussmann Data Sheet 4347; 2009; pp. 1-3.

* cited by examiner

RADIAL FUSE BASE AND ASSEMBLY

BACKGROUND OF THE INVENTION

The field of the invention relates generally to electrical fuses, and more specifically, to the construction and assembly of so-called radial fuses.

Electrical fuses are widely used overcurrent protection devices for electrical circuits. Typically, electrical fuses include a fusible link or fuse element assembly extending between conductive elements that may be connected to circuitry. When installed in an energized electrical circuit, current flows through the fusible link or fuse element assembly. The fusible link or fuse element assembly is designed to physically melt, disintegrate, or otherwise structurally fail when the current flowing through the fuse reaches a predetermined level, thereby opening the electrical circuit through the fuse and protecting associated electrical equipment and components from damage. Once the fusible link has opened the circuit, the fuse may be removed and replaced with another fuse to once again complete the circuit.

So-called radial fuses are known that include a nonconductive base and a pair of axial leads extending from the base for connection to a circuit board. Such radial fuses are used to protect power supplies, power adapters, and battery chargers for a variety of electronic devices. A fusible link extends across the base and is connected to respective ends of the axial leads via soldering techniques. Radial fuses are sometimes preferred for circuit board application because of their smaller size or footprint when installed to a circuit board.

BRIEF DESCRIPTION OF THE INVENTION

In an exemplary embodiment, a radial fuse for protecting an electrical circuit is provided. The fuse comprises a nonconductive base comprising a first end and at least one pair of cradle members extending from the first end. The pair of cradle members comprises inverted slope faces defining a receiving area of more than about 50° for installation of a fuse element.

Optionally, the inverted slope faces are flat and linear. A pair of axial leads may also be provided, with the leads extending through the base, and one of the pair of leads extending between the at least one pair of cradle members. A fuse element may be received between the cradle members and connected to the axial leads. The fuse element may extend transversely to the axial leads. The base may include a cylindrical side wall. A protective cap may be provided, with the base fitted into the cap and enclosing the first end. The base may include a second end opposing the first end, with the second end exposed when the base is fitted into the cap.

The fuse element may be configured to open a current path between the axial leads when specified current conditions occur in the electrical circuit, and a gap of about 1 mm or less extends between the fuse element and the sloped faces to restrain movement of the fuse element. The inverted slope faces may be define a receiving area of at least about 60° for installation of a fuse element.

In another embodiment, an electrical fuse is disclosed that comprises a nonconductive base comprising a first end and opposed pairs of cradle members extending from the first end. Each of the opposed pairs of cradle members comprising inverted flat and linear faces. The flat and linear faces are obliquely sloped and collectively define a receiving area of at least about 60° for installation of a fuse element. A pair of axial leads extend through the base between the respective opposed pairs of cradle members, and a fuse element is soldered to proximal ends of the axial leads and extending between the opposed pair of cradle members, wherein the fuse element extends transversely to the axial leads.

According to another exemplary embodiment, an electrical fuse is provided comprising: means for establishing an electrical connection to a circuit; means for establishing an interruptible current path between the means for establishing an electrical connection to the circuit, wherein the means for establishing an interruptible current path structurally fails upon an occurrence of a specified current condition; a nonconductive means for receiving the means for establishing an electrical current to the circuit and the means for establishing an interruptible current path, wherein the nonconductive means for receiving is configured to provide a gap of about 1 mm or less for the means for establishing an interruptible current path to move; and means for enclosing the means for establishing an interruptible current path but leaving a portion of the nonconductive means exposed.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

As mentioned, the small footprint of radial fuses on a circuit board has rendered them useful for many electronic devices that are becoming increasingly miniaturized. Such devices include notebook computers, printers, MP3 players, mobile phones, high definition televisions, DVD players and set top boxes. In particular, radial fuses are often utilized to protect power supplies, power adapters, and battery chargers of the devices when they are connected to AC electrical outlets in a home or business, for example, that are occasionally prone to overcurrent events. The radial fuses are sometimes referred to as primary circuit protectors that protect sensitive electronic components in the devices from overcurrent conditions in the AC electrical outlets connected to the devices.

Radial fuses, however, can be difficult to assemble and because of such difficulties, they can occasionally present reliability issues. Radial fuses are known having a base that accepts radial leads extending axially through the base. A saddle area is formed in the base and receives a fuse link that is connected between the respective ends of the leads via soldering techniques. During assembly, the fuse link is soldered to the ends of the axial leads, and the leads are pulled down through the base until the fuse link rests in the saddle area of the base. The soldered connections between the fuse link and the axial leads, however, are sometimes prone to failure, rendering the electrical connection through the fuse link partly or wholly inoperable and causing reliability issues in operation of the fuse. The soldered connections are believed to be problematic at least in part due to the construction of the base that receives the leads and the fuse links. Improvements are desired.

Figure 1:
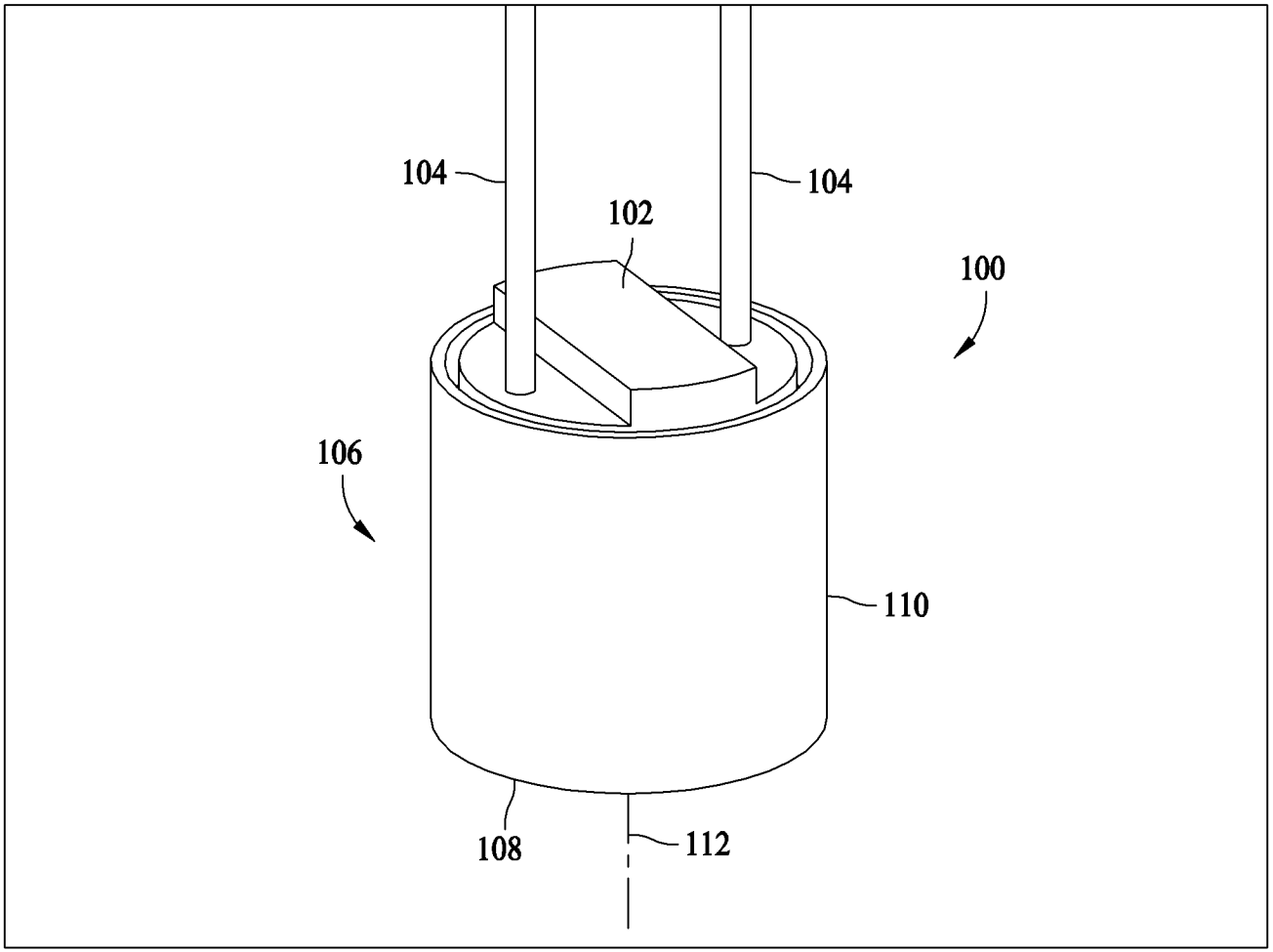
FIG. 1 is a perspective view of an exemplary radial fuse.

FIG. 1 is a perspective view of an exemplary radial fuse 100 including a base 102, axial leads 104 that extend through the base 102, and a protective cap 106.

In the exemplary embodiment shown, the cap 106 has a generally cylindrical outer shape and profile. That is, the cap 106 in the illustrated embodiment includes a flat end wall 108 and a rounded side wall 110 collectively defining a protective enclosure that receives the base 102 and a fuse element or fuse link (described below) extending across the base 102 at an interior location to the cap 106. The cylindrical cap 106 is sometimes preferred due to a relatively small area, sometimes referred to as a footprint, that the fuse 100 occupies on a circuit board in use. It is appreciated, however, that in another embodiment the cap 106 may be alternatively shaped, including but not limited to a rectangular shape or profile.

As seen in FIG. 1, the axial leads 104 extend axially from the base 102 in a generally parallel but spaced-apart relation to one another. In the embodiment depicted, the leads 104 extend in a generally parallel direction to the rounded side wall 110 of the cap 106 and in a direction generally perpendicular to the end wall 108 of the cap 106. Additionally, the leads 104 are positioned approximately equidistantly from an axial centerline of the cap 106, which coincides with an axial centerline of the base, both of which are generally indicated with centerline 112 in FIG. 1. Alternatively stated, in an exemplary embodiment the axial leads 104 are extended at approximately 180° angular positions relative to the centerline 112 and spaced apart from one another at positions slightly spaced radially inwardly from the side wall 110 of the cap 106.

Figure 2:
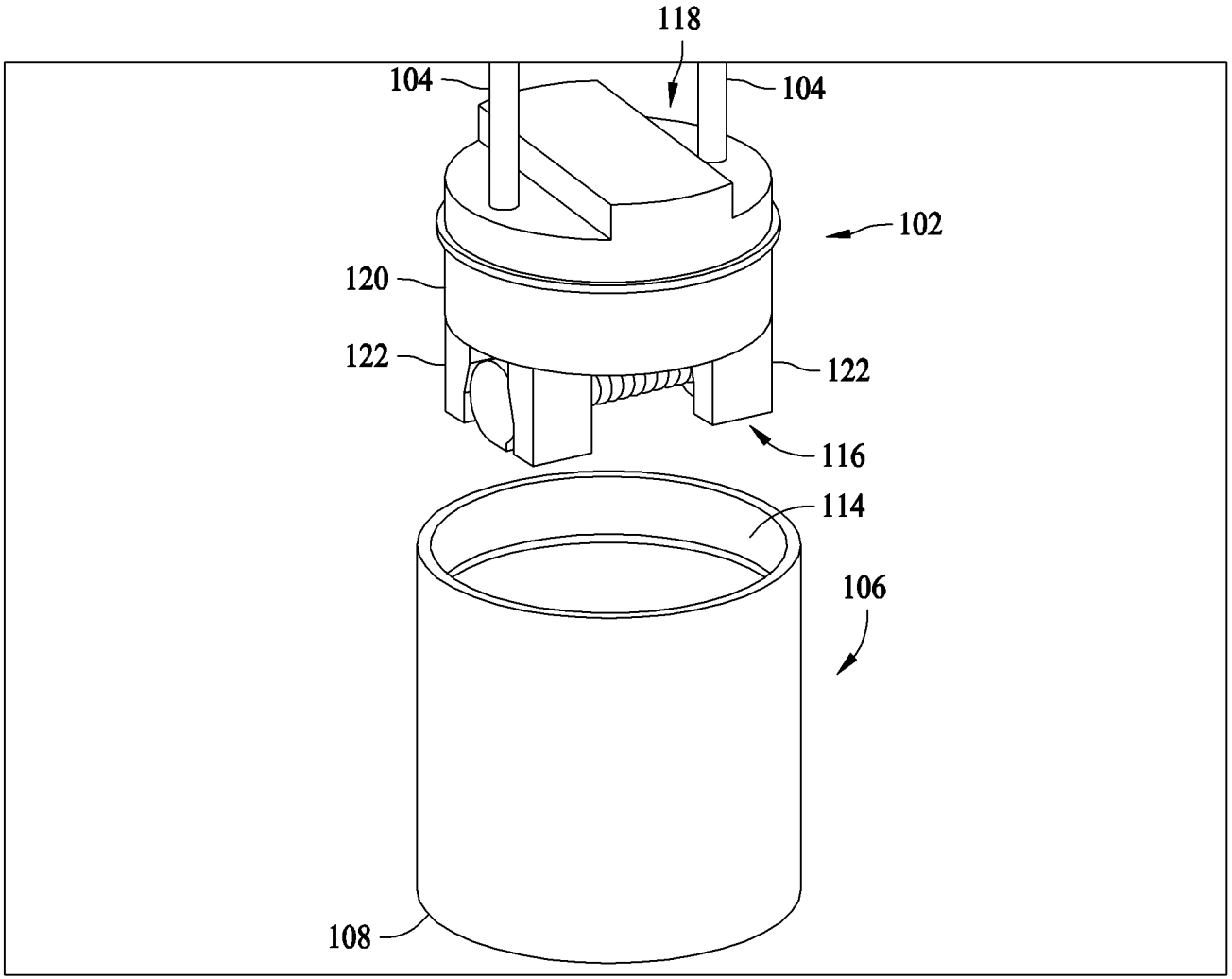
FIG. 2 is a partial assembly view of the radial fuse shown in FIG. 1.

FIG. 2 is a partial assembly view of the radial fuse 100 showing the base 102 before insertion into the cap 106. As is evident from FIG. 2, the cap 106 is hollow and includes an open end 114 opposite the end wall 108. The open end is sized and dimensioned to receive the base 102 and associated leads 104. The base 102 is shaped in a generally complementary manner in its outer profile to the hollow cap 106, and the base 102 and cap 106 may be dimensioned to provide a slight interference fit when the cap 106 and base 102 are assembled. In further and/or alternative embodiments, the cap 106 and base 102 may include snap-fit attachment features, latching features or other attachment features and techniques, including but not limited to adhesives and other elements known in the art to provide secure attachment between the cap 106 and base 102 once assembled.

The base 102, and also the cap 106, may each be fabricated from an injection molded, nonconductive material such as plastic into the generally cylindrical shapes illustrated or other shapes as desired. The base 102 may formed with opposing ends 116 and 118, and a cylindrical side wall 120. The end 116 includes spaced apart cradle members 122 each defining a saddle area or receiving area for the ends of the leads 104 and the fuse link, and when assembled with the cap 106, the end 116 is received within the hollow cap 106 such that the receiving area and the fuse link are fully protected and enclosed by the cap 106, with the end wall 108 of the cap overlying the fuse link and the side wall 110 of the end cap 106. The end 118 faces a circuit board when the fuse 100 is installed thereto.

Figure 3:
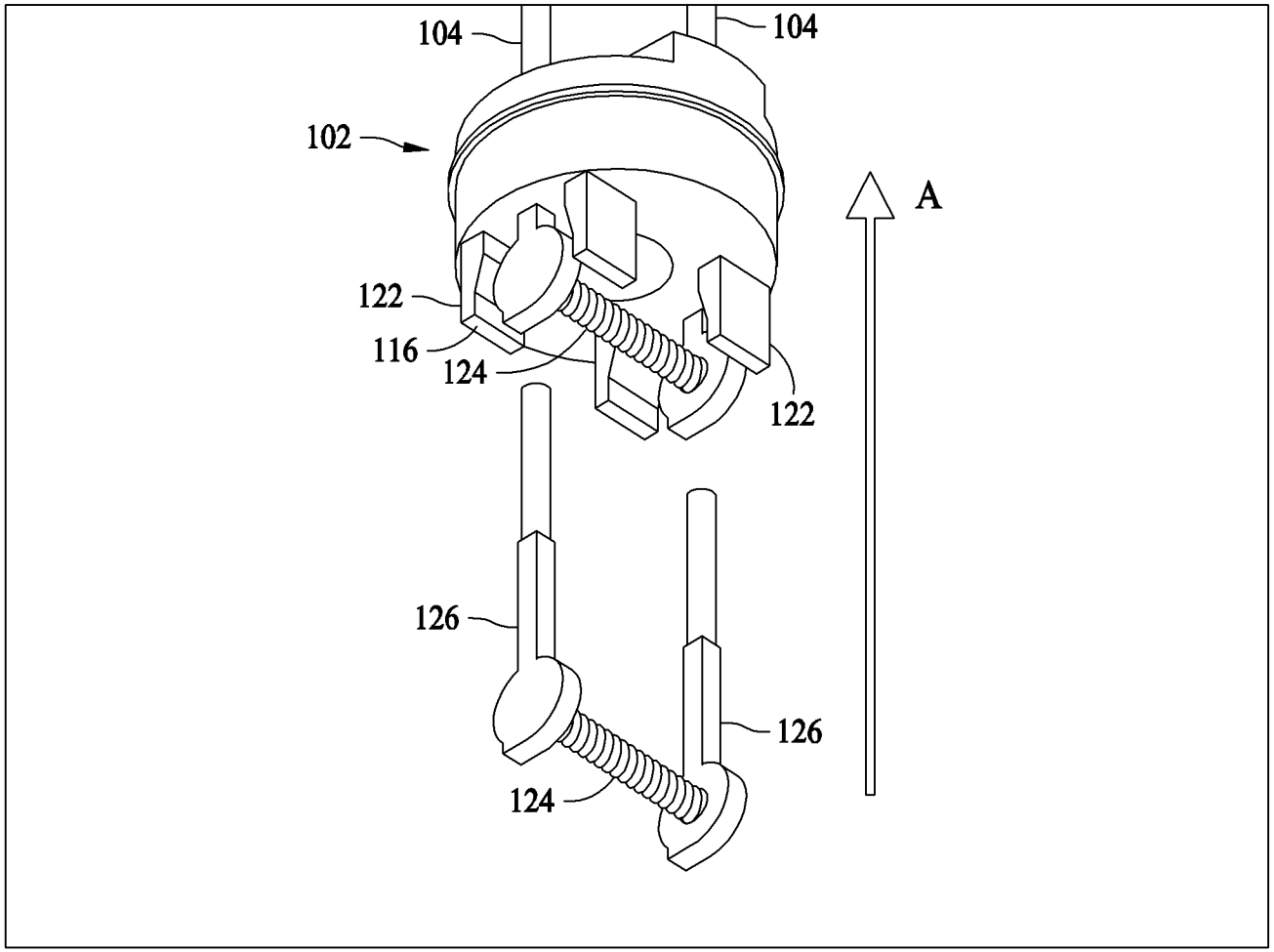
FIG. 3 is another assembly view of the radial fuse shown in FIG. 1.

FIG. 3 illustrates the axial leads 104 and attached fuse element or fuse link 124. The fuse link 124 is connected to the ends of the axial leads 104, and free ends of the leads 104 opposite the fuse link 124 are inserted through respective holes in the base 102. The leads 104 are then pulled through the base 102 in the direction of arrow A until the ends of the leads 104 where attached to the fuse link 124 are received in the respective cradle members 122 of the base 102.

The axial leads 104 in an exemplary embodiment may be conductive wire elements, stamped and formed metal elements. or combinations of both. Each of the leads 104 extends for a predetermined length between a proximal end 126 connecting to the fuse link 124 and an opposing distal end. The through holes in the base that receive the leads 104 may be located, for example, proximate the cradle members 122 and extend completely though the base 102 between the end 116 and the end 118.

The fuse link or fuse element 124 is mechanically and electrically connected to the proximal ends 126 of the leads 104, and extends across the end 116 of the base 102, spanning a distance between the cradle members 122. The fuse element 124 extends generally transverse to the axial leads 104 and extends diametrically on the end 118 of the fuse. Alternatively stated, the fuse link 124 interconnects the axial leads 104 in a substantially U-shaped arrangement, and when the fuse link 124 is seated in the cradle members 122, the fuse link 124 extends across the diameter of the end 116 of the base 102.

Figure 4:
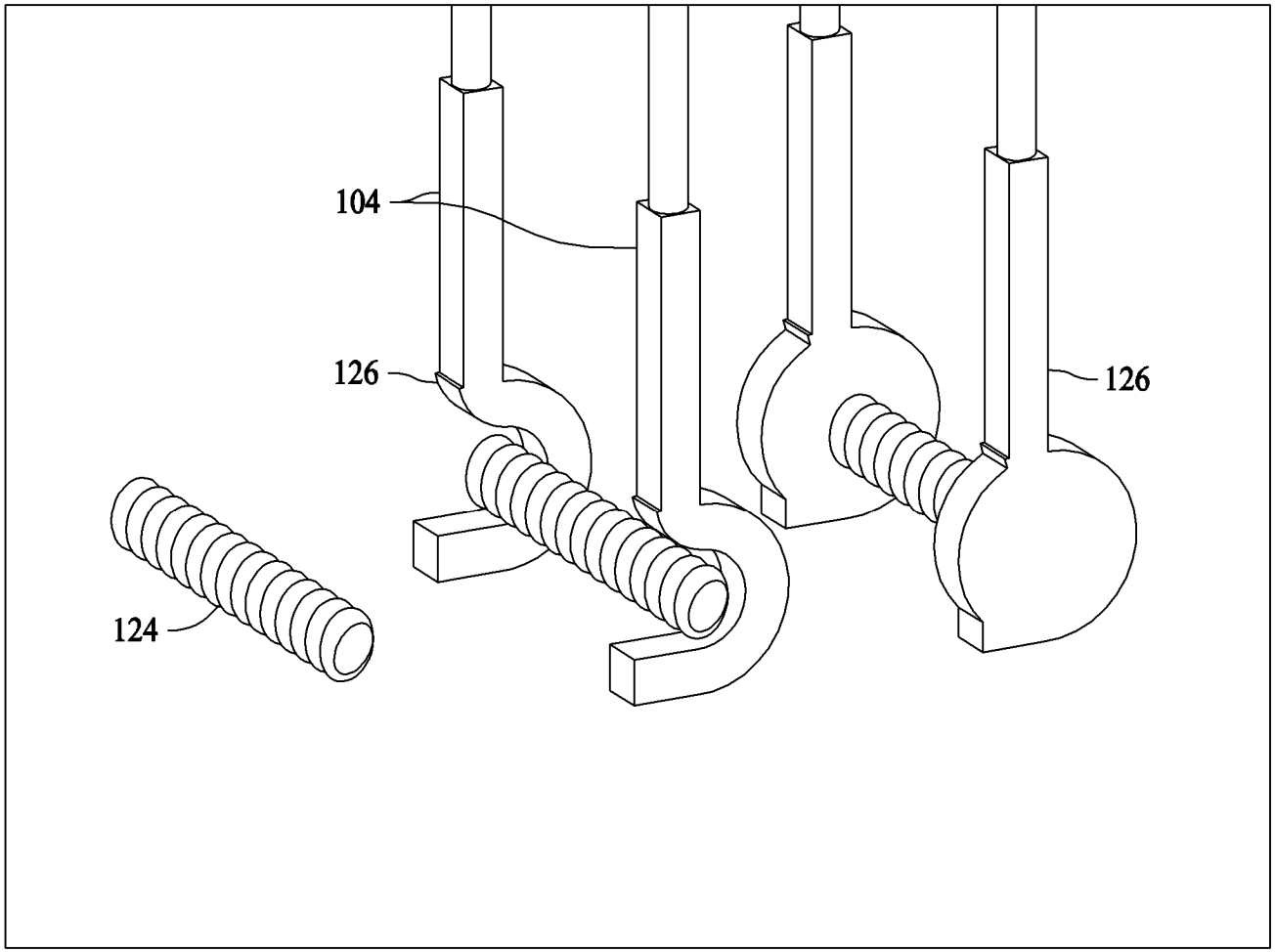
FIG. 4 illustrates an exemplary fuse link and terminal structure for the radial fuse shown in FIG. 3.

FIG. 4 illustrates the fuse link or fuse element 124 being attached to the proximal ends 126 of the axial leads 104. As shown in FIG. 4, in an exemplary embodiment the proximal ends 126 of the leads 104 are bent or otherwise shaped into a rounded eyelet shape into which the fuse element 124 may be fitted. Optionally, once the fuse link 124 is inserted into the shaped ends 126, the ends may be bent further around the ends of the fuse link 124 such that the fuse link 124 is positively captured or secured to the ends 126 of the leads 104. The ends of the fuse link 124 and the leads 104 are soldered together to complete a mechanical and electrical connection between the fuse link 124 and the leads 104. As such, a current path is created through the fuse 100 wherein current may flow from a line side connection of a circuit board to a load side connection of the circuit board when the axial leads 104 are terminated to the circuit board and the circuit is energized.

In accordance with known electrical fuses, the fuse element or fuse link 124, is constructed to melt, vaporize, disintegrate or otherwise structurally fail when a predetermined magnitude of electrical current flows through the fuse for a duration of time, sometimes referred to as an overcurrent condition, that may damage sensitive electronic components. That is, the current path through the fuse element is designed to fail and open the current path through the fuse element 124. By implication, when the fuse element 124 opens, an open circuit results in the circuit to which it is connected and damage to sensitive circuit components may be avoided. The amount of current that the fuse element 124 may sustain before opening the current path may vary depending on its particular material properties and dimensional aspects. Various fuse link or fuse element constructions are known for such a purpose. While in the embodiment illustrated, the fuse element 124 is a spirally wound fuse element, it is contemplated that other types of fuse elements may be utilized in other embodiments. Once the fuse element 124 is opened, the fuse 102 may be replaced to restore the electrical circuitry to full operation.

Figure 5:
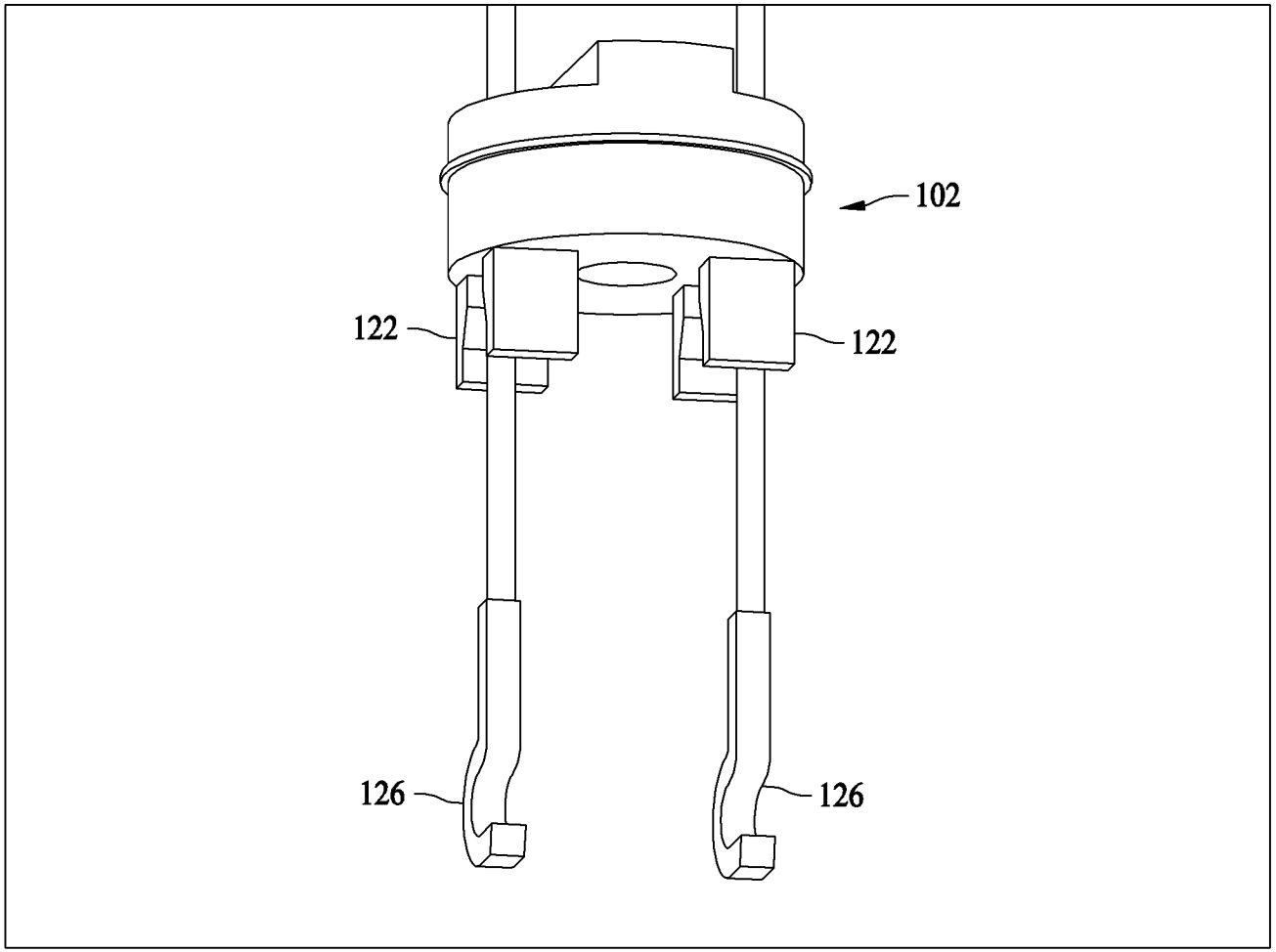
FIG. 5 illustrates the radial fuse assembly shown in FIG. 4 with the fuse link removed.
Figure 6:
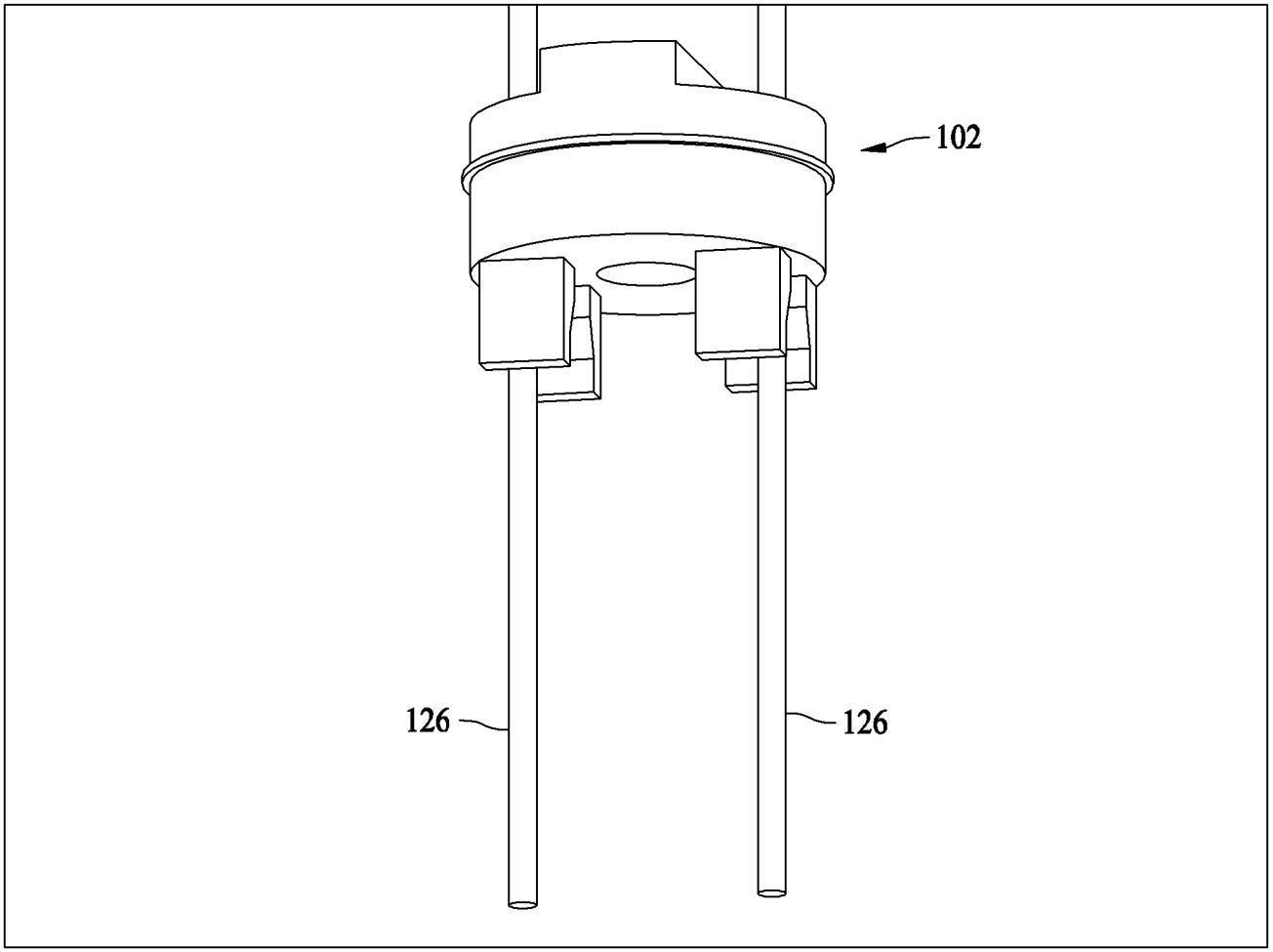
FIG. 6 illustrates the radial fuse assembly shown in FIG. 5 before the leads are shaped.
Figure 7:
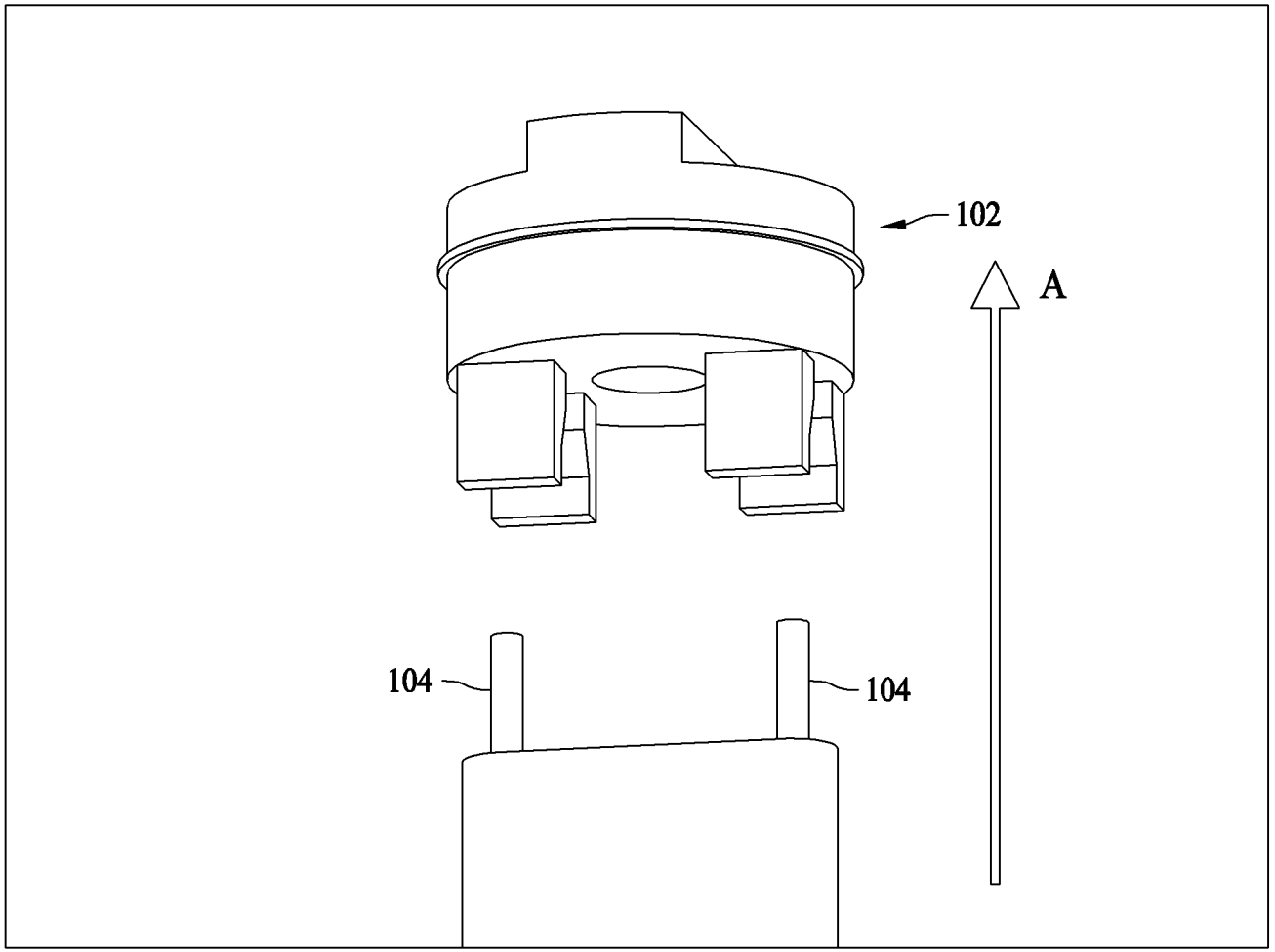
FIG. 7 illustrates a bottom perspective exploded view of the assembly shown in FIG. 6.

FIG. 5 illustrates the leads 104 extended through the base 102 but before the fuse element 124 is installed. FIG. 6 illustrates the leads 104 extended through the base 102 but before the proximal ends 126 are shaped. FIG. 7 illustrates the leads 104 being inserted into the base 102 in the direction of Arrow A.

Figure 8:
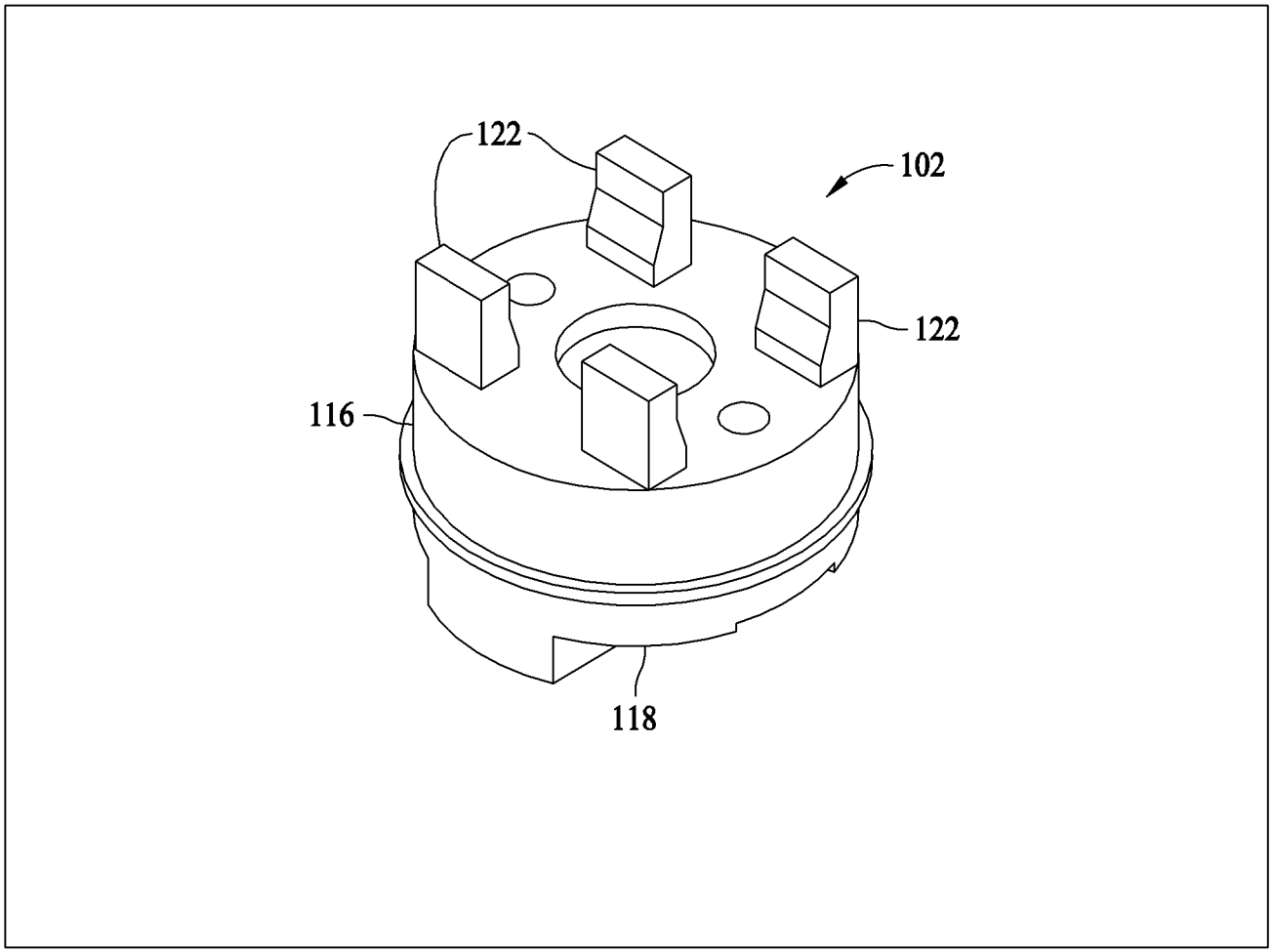
FIG. 8 is a perspective view of an exemplary base for the assembly shown in FIG. 7.

FIG. 8 is a perspective view of the base 102 alone, illustrating the cradle members 122 extending upwardly from the end 118. The cradle members are arranged in pairs on opposing sides of the base 102 and form valley shaped saddle areas or receiving areas for the fuse element 124 and the ends of the leads 104.

Figure 9:
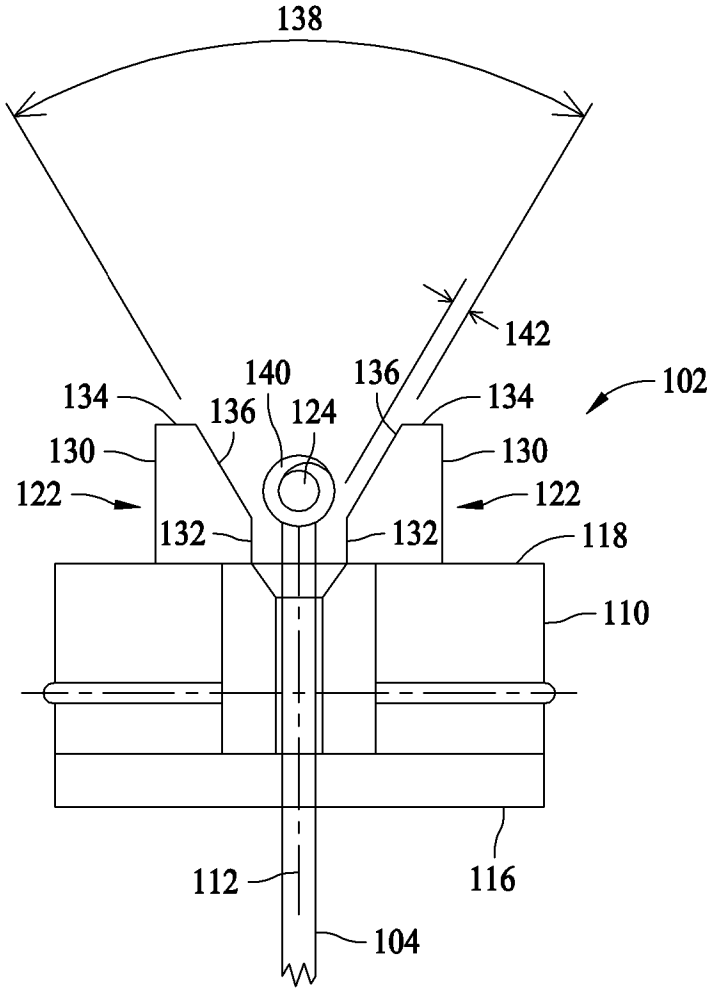
FIG. 9 is a side plan view of the base shown in FIG. 8.

FIG. 9 is a magnified side plan view of a portion of the base 102 illustrating a pair of cradle members 122 in an exemplary embodiment. The cradle members 122 project upwardly from the substantially flat and planar end 118, and are substantially wedge-shaped. The cradle members 122 of the pair are essentially mirror images of one another, and each includes an outer face 130, an inner face 132, a top face 134, and a sloped face 136. The outer and inner faces 130, 132 are spaced apart from one another on the end 118, are substantially vertically oriented. and extend substantially perpendicularly from the flat end 118 in the illustrate embodiment. Further, the outer faces 130 are taller than the inner faces 132, measured in a direction normal to the end 118.

The top face 134 of each cradle member 122 is substantially horizontally oriented and is generally parallel to, but spaced from, the plane of the flat end 118. The top face 134 further extends from the outer face 130 of each cradle member 122 in an inward direction toward the centerline 112 and toward the opposing cradle member 122. The sloped face 136 of each cradle member 122 connects a top end of the inner face 132 with the end of the top face 134 that opposes the outer face 130. The sloped faces 136 are each flat and linear and extend obliquely relative to the flat end 118. In an exemplary embodiment, the sloped faces extend at approximately 30° angles relative to the centerline 112 of the base. Because the cradle members 122 are mirror image of one another, however, the sloped faces 136 are inverted relative to one another and define a mouth area that is wider near the top faces 134 than near the inner faces 132. In the example, shown the inverted sloped faces 136 collectively define a relatively wide receiving area 138 over the cradle members 122, and the receiving area 138 tapers in width considerably as the sloped faces 136 approach the inner faces 132. In the example shown, the receiving area 138 spans approximately a 60° angle, and more specifically a 63° angle, although greater or lesser angles may be utilized in other embodiments.

The combination of the flat and linear sloped faces 136, as opposed to curvilinear faces, and a relatively wide receiving area (e.g., the 63° angle between the sloped faces 136) is beneficial in several aspects. When the fuse element 124 and the leads 104 with soldered connections 140 are seated between the cradle members 122, a gap 142 between the fuse element and the sloped faces 136 is practically minimized. For example, in one embodiment the gap 142 is about 1 mm or less. Because of the substantially minimized gap 142, the freedom of movement of the fuse element 124 and associated solder 140 is much more restricted than in other known radial fuse constructions and the soldered connection 140 is more securely retained to the base 102. Accordingly, instances of the soldered connection 140 failing, which is believed to be attributable to undesirable movement of the fuse element 124 relative to the base 102 is substantially reduced, if not eliminated. This is especially so when the fuses 102 are subject to vibration, either before or after installation.

Figure 10:
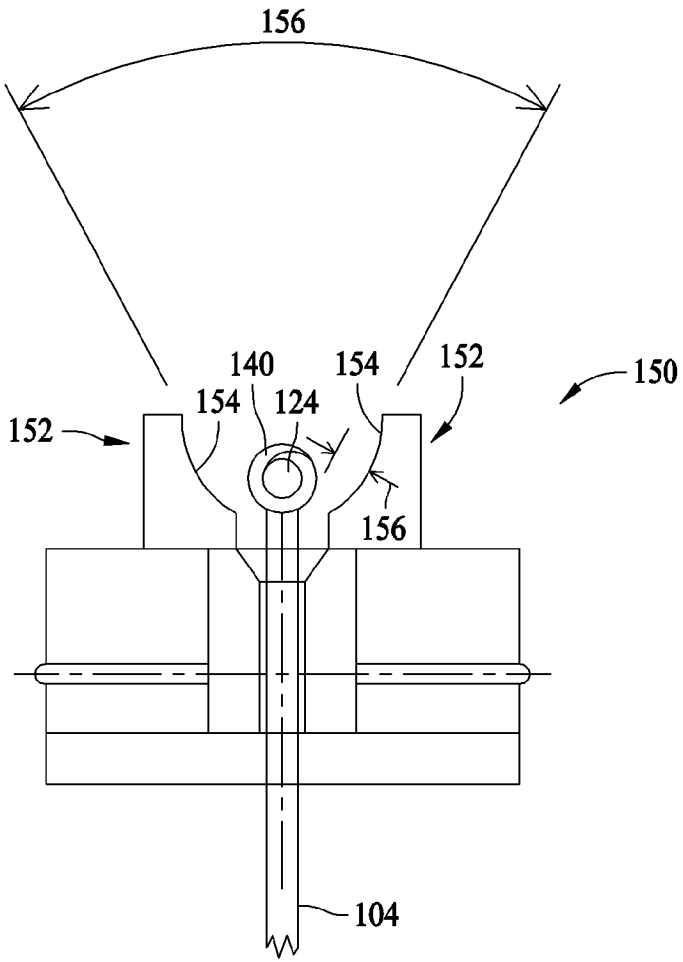
FIG. 10 Prior Art
FIG. 10 is a side plan view of a known base construction for a radial fuse.

For comparative purposes FIG. 10 illustrates a known base construction for a radial fuse. The base 150 includes cradle members 152 have curvilinear guide surfaces 154 opposing one another, and a narrower receiving area 156 of about 48° over the cradle members. While the curvilinear guide surfaces 154 and narrower receiving area 156 are intended to securely position the fuse element 124 relative to the cradle members 152, the ultimate position of the fuse link 124 is actually somewhat variable. A rather large gap 156 of about 1.5 mm has been found to exist between the soldered connection 140 and the curvilinear faces 154 of the cradle members 152, allowing the fuse element 124 additional freedom to move relative to the cradle members. Such movement is believed to be responsible for reliability issues in the soldered connections 140.

By eliminating the curved surfaces 154 in favor of flat sloped surfaces 136 (FIG. 9), and also by widening the receiving area 138 by about 30% (e.g., from about 48° to about 63° in the examples shown) to provide the wider receiving area 138 (FIG. 9), more reliable positioning of the fuse element 124 with a consistently smaller gap 142 (FIG. 9) may be consistently achieved. Fuse reliability is accordingly increased with minimal effect on costs of producing radial fuses.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical fuse for protecting electrical circuitry on a circuit board, the electrical fuse comprising:

a nonconductive base comprising a first end and first and second opposed pairs of cradle members extending from the first end, each of the first and second opposed pairs of cradle members comprising opposing flat and linear faces having an inverted slope relative to one another, the opposing flat and linear faces being obliquely sloped and collectively defining a receiving area of at least about 60°;

a pair of axial leads extending through and exposed from the base for connection to the circuit board, and a respective one of the pair of axial leads extending through the base between each of the opposed pairs of cradle members; and a fuse element in the receiving area and soldered to proximal ends of the pair of axial leads, the fuse element extending between each of the opposed pair of cradle members and extending transversely to the axial leads.

2. The fuse of claim 1, further comprising a nonconductive cap coupled to the base and enclosing the fuse element.

3. The fuse of claim 2, wherein the cap comprises a cylindrical side wall.

4. The electrical fuse of claim 3, wherein the pair of axial leads extend through the base in a generally parallel orientation to the cylindrical side wall of the cap.

5. The electrical fuse of claim 4, wherein the cap includes an axial centerline, and the pair of axial leads are positioned approximately equidistantly from the axial centerline.

6. The fuse of claim 2, wherein the fuse element is configured to open a current path between the axial leads in response to specified current conditions in the electrical circuitry, and wherein a gap of about 1 mm or less extends between the fuse element and the flat and linear faces to restrain movement of the fuse element.

7. The fuse of claim 2, wherein the base comprises a second end opposing the first end, and the second end is exposed when the cap is coupled to the base.

8. The electrical fuse of claim 1, wherein the nonconductive base further comprises a second end opposing the first end, and the pair of axial leads extending through the base in a generally perpendicular orientation to the second end.

* * * * *